US007152390B2

(12) United States Patent
Weiser et al.

(10) Patent No.: US 7,152,390 B2
(45) Date of Patent: Dec. 26, 2006

(54) SPANDEX COVERED TIGHTLY WITH SHRINKABLE NYLON AND PROCESS FOR PRODUCING IT

(75) Inventors: Alon Weiser, Netanya (IL); Abed Zuabe, Nazareth (IL); Uri Afek, Tivon (IL); Martin Blutstein, Tivon (IL); Stephen D. Lipshitz, Haifa (IL)

(73) Assignee: Nilit Ltd., Migdal Ha'Emek (IL)

( * ) Notice: Subject to any disclaimer, the term of this patent is extended or adjusted under 35 U.S.C. 154(b) by 0 days.

(21) Appl. No.: 11/086,020

(22) Filed: Mar. 22, 2005

(65) Prior Publication Data

US 2005/0241286 A1 Nov. 3, 2005

Related U.S. Application Data

(63) Continuation of application No. PCT/IL03/00802, filed on Oct. 7, 2003.

(30) Foreign Application Priority Data

Oct. 7, 2002 (IL) ..... 152155

(51) Int. Cl.
*D02G 3/02* (2006.01)

(52) U.S. Cl. ..... 57/225; 57/6

(58) Field of Classification Search ..... 57/210, 57/225–228, 231, 232
See application file for complete search history.

(56) References Cited

U.S. PATENT DOCUMENTS 3,788,365 A 1/1974 Campbell, Sr. et al.
4,057,880 A 11/1977 Matthews et al.
4,467,595 A * 8/1984 Kramers ..... 57/225
4,998,421 A 3/1991 Zafiroglu
5,249,414 A * 10/1993 Iwata et al. ..... 57/225
5,478,514 A 12/1995 Hamilton
5,823,014 A * 10/1998 Kobayashi et al. ..... 66/178 R
5,987,933 A * 11/1999 Metzler ..... 66/202
6,151,927 A 11/2000 Owens et al.
6,240,716 B1 6/2001 Yanagawase et al.
6,413,635 B1 7/2002 Martin et al.
6,460,322 B1 10/2002 Sato et al.
2002/0045395 A1 4/2002 Lintecum et al.

FOREIGN PATENT DOCUMENTS

JP 2000073231 3/2000

* cited by examiner

*Primary Examiner*—Shaun R. Hurley
(74) *Attorney, Agent, or Firm*—Frommer Lawrence & Haug LLP; William S. Frommer; Marilyn M. Brogan

(57) ABSTRACT

A process is provided for making a yarn with improved properties, such as lowered susceptibility to picks and snags. The yarn consists of a spandex core that is tightly covered with a nylon fiber, which tight covering is achieved by heat treatment. A knitted fabric is further provided, that is made of yarn consisting of a spandex core and a nylon fiber, which has low susceptibility to picks, as well as to tears during its production and its use.

25 Claims, 2 Drawing Sheets

SPANDEX COVERED TIGHTLY WITH SHRINKABLE NYLON AND PROCESS FOR PRODUCING IT

This is a continuation of copending International Application PCT/IL2003/000802 having an international filing date of Oct. 7, 2003.

FIELD OF THE INVENTION

The present invention relates to a synthetic yarn made of spandex yarn wrapped with nylon yarn. This product is known in the trade by the name covered spandex. A particularly tight wrapping imparts to the yarn, and to the fabric made of it as well, improved properties, such as lowered susceptibility to picks and snags.

BACKGROUND OF THE INVENTION

Among the most widely used synthetic fibers in the clothing industry are spandex and nylon yarns. Spandex is usually combined in fabrics with other types of fibers, and imparts to the fabrics elasticity. Nylon yarns are universally used for their versatility, either alone or blended with other yarns. An important yarn, especially used in hosiery, is spandex covered with nylon. The type of wrapping affects the transparency, softness, and durability of the covered spandex and the garment in which it is used. Use of such yarn is described, e.g., in U.S. Pat. No. 3,788,365 where this material was employed for making elastic waistbands. U.S. Pat. No. 5,478,514 describes a process for preparing a woven fabric of spandex and nylon, and the heat treatment of the fabric at a temperature from 80° C. to 180° C.

In the covered spandex yarn of the prior art, the nylon fiber does not tightly wrap the whole length of the spandex core, but it winds around the spandex axis rather in the form of an irregular and fuzzy coil, with loops of various sizes sticking out. These loops are undesired and are susceptible to picks and snags of filament, causing tears of the fabric during its production or in use of the garment. It is therefore an objective of this invention to provide a yarn in which spandex is wrapped with nylon yarn more tightly, resulting in reduced protrusions of nylon loops perpendicularly to spandex core.

It is another object of this invention to provide a fabric based on spandex/nylon with lowered susceptibility to picks and snags.

Other objects and advantages of present invention will appear as description proceeds.

SUMMARY OF THE INVENTION

This invention provides a process for making a yarn having a spandex core covered tightly with a nylon fiber, comprising i) providing a highly shrinkable nylon fiber having a shrinkage in boiling water of at least 20%, and preferably at least 23%, and in which the nylon is preferably a copolymer of nylon 66 and nylon 6; ii) providing a spandex fiber having 11 dtex-400 dtex; iii) wrapping said spandex fiber with said nylon fiber using a standard covering method on standard industrial machines, thereby obtaining a composite yarn consisting of a spandex core with a high shrinkage nylon wrapping; and iv) heat-treating said composite yarn, at a temperature range from 85 to 105° C.; thereby obtaining a yarn consisting of an initially highly shrinkable nylon fiber wrapping tighter around a spandex core. Said heat-treating can be performed either before or after using said yarn in knitting a fabric.

The invention also provides a yarn consisting of a spandex fiber core, and a nylon fiber wrapping of which initial shrinkage is at least 20%, preferably at least 23%, and which wraps tightly said spandex fiber after exposure to heat-treatment at a temperature 85 to 105° C., as indicated by micrographs, and snagging tests.

The invention further relates to a fabric, as well as to articles made of such a fabric, which comprises the aforesaid yarn. The fabric of this invention has a low susceptibility to picks and snags.

BRIEF DESCRIPTION OF THE DRAWINGS

The above and other characteristics and advantages of the invention will be more readily apparent through the following examples, and with reference to the appended drawings, wherein.

DETAILED DESCRIPTION OF THE INVENTION

Figure 1A:
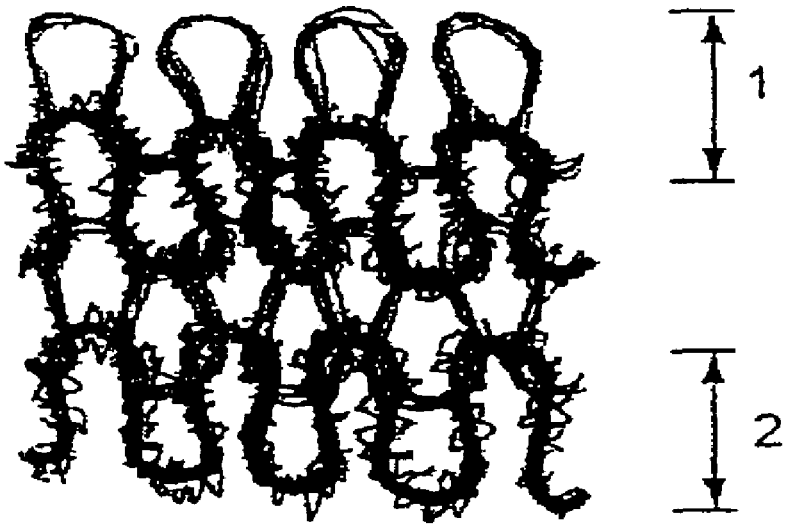
Fig. 1A (PRIOR ART)
FIG. 1. is a schematic illustration of spandex covered with nylon according to A) standard methods, and according to B) this invention.

It has now been found that wrapping a spandex fiber with a fiber made of highly shrinkable copolymer of nylon 6,6 and nylon 6, followed by wet heat treatment of the composite fiber, yields a yarn with surprisingly improved properties. This yarn, and the fabric made of this yarn as well, exhibits tight packing of the two types of fibers, namely spandex and nylon, resulting in lowered susceptibility to picks and snags of filaments in the yarn. Due to said tight packing, the fabric of this invention is also sheerer than a fabric made by standard methods, which is a desired visual property. Said tighter packing can be demonstrated by various methods known in the art, e.g., by microscopy, or by snagging tests.

A process according to this invention comprises i) providing a nylon fiber having a shrinkage higher than 20% (measured as boiling water shrinkage) and preferably higher than 23%; ii) wrapping a spandex fiber with aforesaid high shrinkage nylon fiber, employing standard covering methods, preferably a single covering method, using standard commercial equipment, e.g., ICBT machines, or other methods known in the art, whereby to obtain a composite yarn consisting of spandex core and high shrinkage wrapping; and iii) treating said composite yarn, either before or after producing from it a fabric, at a temperature from 85 to 105° C.

In a preferred embodiment of to this invention, said spandex core has a thickness from 20 dtex to 70 dtex, and said nylon fiber has a thickness from 11 dtex to 150 dtex, and said nylon fiber wrapps said core in the range of from 1200 to 3000 TPM.

The shrinkage of nylon in boiling water is a known property, and is reported in the literature. Such shrinkage can be observed upon dyeing of nylon yarn in hot water. This property of nylon is sometimes used for modifying its appearance. For example, U.S. Patent Application Publication No. 20020045395 describes a two fiber yarn, possibly comprising nylon, of which one fiber is made of two components differing in the rate of shrinkage, whereas a fabric made of said yarn exhibits improved appearance. However, standard nylon fibers exhibit only mild shrinkage in boiling water, not exceeding 10%. Japanese Patent No. 2000073231 describes a method for obtaining a highly shrinkable nylon fiber by copolymerizing nylon 6 with less amount of nylon 66, and eventually by copolymerizing said two nylons with phthalic acid.

In one embodiment of this invention, a highly shrinkable nylon fiber is prepared according to methods described in the art.

In a preferred embodiment of this invention, a highly shrinkable nylon fiber is provided by polymerizing nylon 66 with less amount of nylon 6, without other co-monomers. Nylon yarn used for covering spandex core yarn is obtained by copolymerization of nylon 66 and nylon 6 at the ratio preferably of between 68:32 and 88:12, and still more preferably about 78:22. Any type of spandex can be used. A high shrinkage nylon fiber is obtained, with a shrinkage from 16 to 40%, preferably from 20 to 30%.

This invention provides a yarn that consists of a nylon fiber of a thickness from 11 to 150 dtex of which initial shrinkage is at least 20%, preferably at least 23%, and spandex fiber core of a thickness from 11 to 400 dtex which is wrapped by said nylon fiber tightly in the range of from 1200 to 3000 TPM, wherein said tight wrapping prevents picks and snags of filaments of the yarn. In a preferred embodiment, the nylon yarn comprises a copolymer of nylon 66 and nylon 6 in a ratio of from 68:32 to 88:12. In one embodiment of this invention, the yarn according to this invention is used for knitting the fabric, and the finished fabric is heat treated. In another embodiment, the yarn is heat treated directly after its production, before its use in producing the fabric. The heat treatment comprises dipping the garment or the yarn in water or water solutions at a temperature between 85 and 105° C., preferably in boiling water. In a preferred embodiment of this invention, the heat treatment is a part of a dyeing process.

Figure 1B:
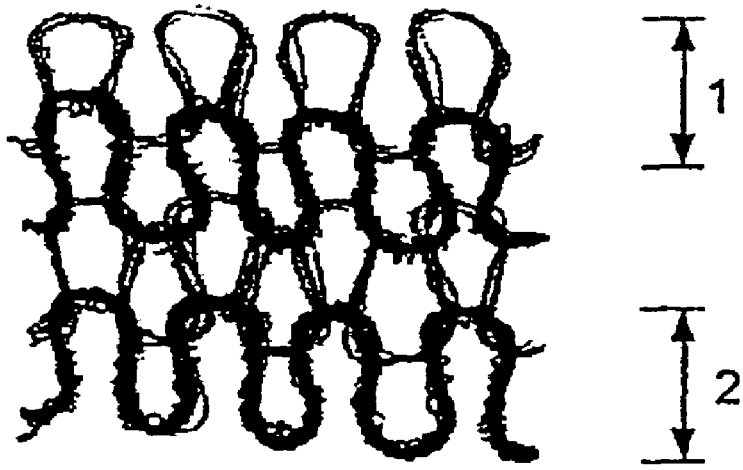
Figure 2A:
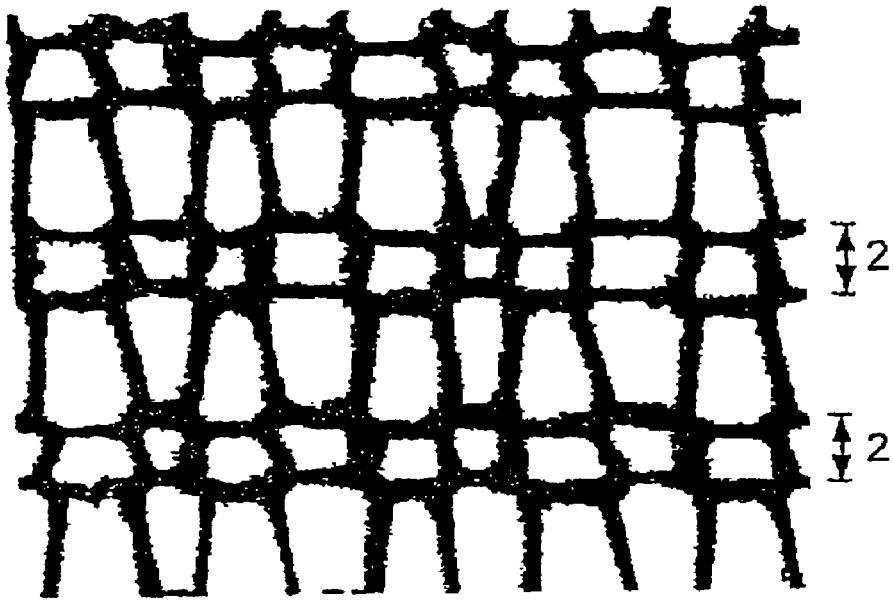
Fig. 2A (PRIOR ART)
FIG. 2. is a drawing based on micrographs of A) a fabric made of standard yarn, and of B) a fabric made of a yarn according to this invention.
Figure 2B:
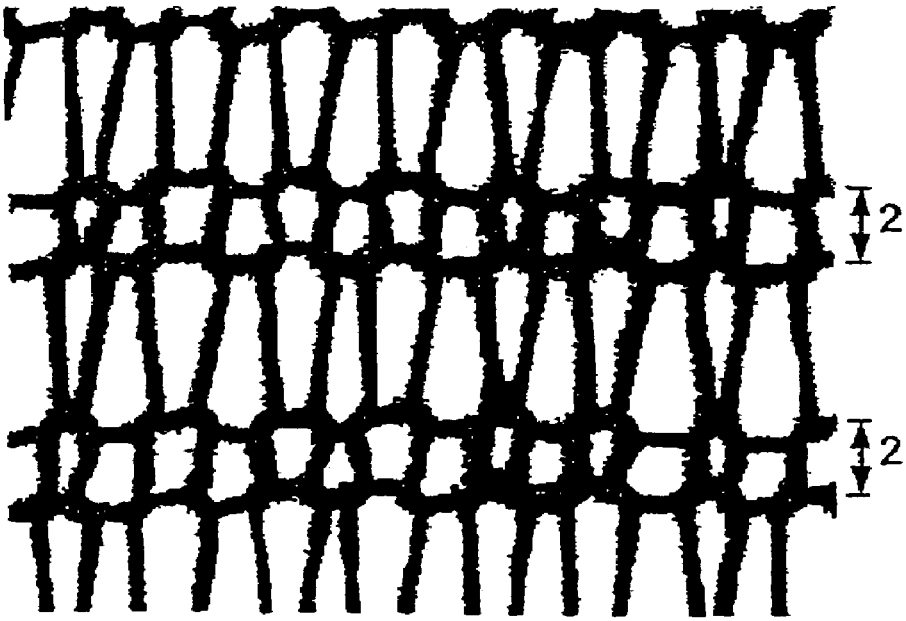

This invention relates also to a fabric made from a yarn having a spandex core tightly wrapped with a nylon fiber, wherein said tight wrapping is achieved by heat treatment. One of the preferred embodiments is the use of a yarn made of spandex tightly covered with a highly shrinkable nylon in hosiery. Micrographs of a fabric can show the tightening of the fabric structure comprising a yarn of the present invention after the heat treatment, in comparison with a fabric comprising a standard yarn. FIG. 2 demonstrates tightening in the sections made of covered spandex (2) in the fabric made according to the present invention (B), compared to standard fabric (A). Lower susceptibility of the fabric according to this invention to picks and snags is a result of the yarn tighter structure, with reduced protrusions of nylon loops perpendicularly to spandex core, as is illustrated in FIG. 1, in which areas of alternate yarn (1) and areas of covered yarn (2) are depicted, and smoother structure of covered yarn with high shrinkage nylon is shown (B) compared to standard nylon (A).

A fabric according to the present invention is obtained in a process comprising i) producing a yarn having a spandex core that is tightly covered with nylon, wherein said tight wrapping is achieved by heat treatment; ii) knitting a fabric that comprises said yarn, either as a single component or in mixture with other yarns; and iii) dyeing comprising dipping in a water solution at a temperature from 85 to 105° C.; wherein the steps of knitting and dyeing can be performed in any order.

This invention thus relates also to a textile article containing a yarn made of spandex tightly covered with a highly shrinkable nylon. A preferred embodiment of this invention is a hosiery article, such as stockings.

In a preferred embodiment of fabric according to this invention, nylon 66 and nylon 6 are copolymerized in the ratio 78%:22%, and the fiber thus obtained has shrinkage at least 23%.

EXAMPLES

Materials and General Procedures

Materials

Spandex in the range of 11–400 dtex was obtained from DuPont, Hyosung, Asahi, and Bayer. Nylon 6,6 was produced from hexamethylene diamine and adipic acid which were obtained from DuPont, Monsanto, BASF and Rhone Polenc. Caprolactam was obtained from BASF.

Covering Process

The high shrinkage yarn was wound on spools at 1500 m/min, and then wrapped around the spandex core at 1700 turns per meter (TPM).

Knitting and Dyeing

A standard, four feed pantyhose knitting machine was used; two feeds for covered spandex, and two feed for an alternate nylon yarn, e.g., 17/7. The standard dyeing process was employed, with anionic or cationic dye-stuff, using boiling water.

Evaluation of the Product

Practical properties of the product were checked by its real use by people of a "wearer group", by wearing the produced pantyhose, washing it, and comparing its performance with a control garment.

The product was further evaluated under a high magnification microscope, usually 100–300×, which revealed the geometry of the fibers.

Example 1

Pantyhose products according to this invention were knitted as described in the procedures above, employing two feeds of spandex 22 covered with high shrinkage 13/7 yarn, 1700 TPM, and two feeds of nylon 17/7. Control pantyhose products were knitted by employing two feeds of spandex 22 covered with standard 11/7 nylon yarn, 1700 TPM, and two feeds of nylon 17/7. The microscope evaluation showed tighter geometry of the covered spandex area, in case of the fabric made according to the present invention (FIG. 2).

Example 2

Pantyhose products of example 1 were knitted, sewn, and dyed by standard manufacturing process. The number of tears formed during the production was checked. The products made according to the invention exhibited by 30% less tears.

While this invention has been described in terms of some specific examples, modifications and variations are possible. It is therefore understood that within the scope of the appended claims, the invention may be realized otherwise than as specifically described.

The invention claimed is:

1. A process for making a yarn having a spandex core covered tightly with a nylon fiber, comprising:

i) providing a highly shrinkable nylon fiber having a shrinkage in boiling water at least 20%;

ii) providing a spandex fiber having a thickness from 11 dtex to 400 dtex;

iii) wrapping said spandex fiber with said nylon fiber using a standard covering method, thereby obtaining a composite yarn consisting of a spandex core with a high shrinkage wrapping; and iv) heat-treating said composite yarn, without stretching it, at a temperature from 85 to 105° C.; thereby obtaining a yarn consisting of a spandex fiber wrapped tightly with an initially highly shrinkable nylon fiber, wherein the heat-treating may be performed before or after said composite yarn is used in preparation of a fabric.

2. The process of claim 1, wherein said highly shrinkable nylon fiber has a shrinkage of at least 23%.

3. The process of claim 1, wherein said highly shrinkable nylon comprises a copolymer of nylon 66 and nylon 6.

4. The process of claim 3, wherein said copolymer contains nylon 66 and nylon 6 in a ratio of from 68:32 to 88:12.

5. The process of claim 3, wherein said copolymer contains nylon 66 and nylon 6 in a ratio of about 78:22.

6. The process of claim 1, wherein said spandex has a thickness from 20 dtex to 70 dtex.

7. The process of claim 1, wherein said covering method is a standard single covering method.

8. The process of claim 1, wherein said heat-treating is performed during a dyeing process.

9. The yarn manufactured according to claim 1, consisting of a spandex fiber core, and a nylon fiber that wraps tightly said core in the range of from 1200 to 3000 TPM.

10. The yarn of claim 9, wherein the initial shrinkage of the nylon fiber is at least 20%.

11. The yarn of claim 10, wherein said shrinkage is at least 23%.

12. The yarn of claim 9, which was exposed to heat-treatment comprising a temperature from 85° C. to 105° C., whereby said nylon fiber was wrapped tightly around said spandex fiber.

13. The yarn of claim 9, wherein said tight wrapping prevents picks and snags of filaments of the yarn.

14. The yarn of claim 9, wherein said nylon comprises a copolymer of nylon 66 and nylon 6.

15. The yarn of claim 14, wherein said copolymer contains nylon 66 and nylon 6 in a ratio of from 68:32 to 88:12.

16. The yarn of claim 15, wherein said copolymer contains nylon 66 and nylon 6 in a ratio of about 78:22.

17. The yarn of claim 9, wherein said spandex has a thickness from 11 to 400 dtex.

18. The yarn of claim 9, wherein said nylon fiber has a thickness from 11 to 150 dtex.

19. A knitted fabric comprising the yarn of claim 9.

20. A knitted fabric made of the yarn of claim 12, wherein said yarn was exposed to said heat treatment before its incorporating to the fabric.

21. A knitted fabric made of the yarn of claim 12, wherein said yarn was exposed to said heat treatment after its incorporating to the fabric.

22. The knitted fabric of claim 19, being pantyhose or apparel garments.

23. A fabric that comprises the yarn of claim 9, consisting of a spandex fiber core wrapped with a nylon fiber, wherein the initial shrinkage of said nylon fiber is at least 20%, and wherein the fabric has low susceptibility to picks and snags.

24. The fabric of claim 23, wherein said initial shrinkage is at least 23%.

25. The fabric of claim 23, which has low susceptibility to tears during its production and its use.

* * * * *